United States Patent [19]

Homma et al.

[11] Patent Number: 4,808,367

[45] Date of Patent: Feb. 28, 1989

[54] PROCESS FOR PREPARATION OF A SYNTHETIC FIBER BUNDLE

[75] Inventors: Shiro Homma, Iwakuni; Masatoshi Kashiwagi, Yuu; Hiroyuki Arita, Iwakuni, all of Japan

[73] Assignee: Mitsui Petrochemical Industries, ltd., Tokyo, Japan

[21] Appl. No.: 779,434

[22] Filed: Sep. 24, 1985

[30] Foreign Application Priority Data

Sep. 25, 1984 [JP] Japan ..... 59-198669

[51] Int. Cl.[4] ..... B29B 7/14

[52] U.S. Cl. ..... 264/555; 264/211; 264/211.12; 264/211.22; 264/349

[58] Field of Search ..... 264/349, 211, 211.22, 264/555, 211.12; 525/179

[56] References Cited

U.S. PATENT DOCUMENTS

| | | | |
|---|---|---|---|
| 2,505,125 | 4/1950 | List | 264/349 |
| 3,373,222 | 3/1968 | Armstrong | 525/179 |
| 3,681,280 | 8/1972 | Beghelli et al. | 264/211 |
| 4,213,747 | 7/1980 | Friedrich | 264/211.22 |
| 4,320,041 | 3/1982 | Abe et al. | 264/349 |
| 4,410,482 | 10/1983 | Subramanian | 264/349 |

FOREIGN PATENT DOCUMENTS

| | | |
|---|---|---|
| 28-617 | 2/1953 | Japan . |
| 35-11851 | 8/1960 | Japan . |
| 44-21167 | 10/1969 | Japan . |

*Primary Examiner*—Jan H. Silbaugh
*Assistant Examiner*—Hubert C. Lorin
*Attorney, Agent, or Firm*—Sherman and Shalloway

[57] ABSTRACT

A non-water swelling or a water-insoluble thermoplastic resin, water and an assistant for assisting dispersion of water into the thermoplastic resin are melt-kneaded and the kneaded composition is extruded from an orifice under such conditions that flashing of water is prevented. As the assistant, a water-soluble resin or a water-insoluble resin having a carboxylic acid salt group is used optionally in combination with a surface active agent. The spun product is a fiber bundle in which single filaments having a diameter smaller than 100 μm are gathered in parallel to one another, and this fiber bundle is easily opened.

17 Claims, 4 Drawing Sheets

PROCESS FOR PREPARATION OF A SYNTHETIC FIBER BUNDLE

BACKGROUND OF THE INVENTION (1) Field of the Invention

The present invention relates to a process for the preparation of synthetic fibers. More particularly, the present invention relates to a process for the preparation of synthetic fibers, in which a fiber bundle of a number of single filaments, especially monofilaments, arranged in parallel to one another can be spun from a single orifice or nozzle. According to the present invention, such fibers can be prepared even from low density polyethylene and an ethylene/vinyl acetate copolymer.

(2) Description of the Prior Art

Various techniques have heretofore been proposed in connection with ultra-fine filament bundles having a diameter smaller than several hundred microns and processes for the preparation thereof. For example, there can be mentioned a process in which ultra-fine filaments are prepared by the super-draw method (Japanese Patent Publication No. 617/53), the flash spinning method (Japanese Patent Publication No. 11851/60) or the jet spinning method and many ultra-fine filaments are gathered by using a binder component or by mechanical twisting (in case of ultra-fine filaments, gathering by mechanical twisting substantially difficult). However, when the super-draw method is adopted, kinds of applicable resins are limited and since a special drawing step is necessary after spinning, the scale of the apparatus is increased and the structure becomes complicated. Although many resins are applicable to the flash spinning method, only short fibers are formed and it is difficult to obtain continuous filaments. Furthermore, since the solvent is scattered at the flashing step, the method is not preferred from the viewpoint of the safety or working environment. The jet spinning method is disadvantageous in that a spinneret having a special shape should be used, and this method involves the same problems as described with reference to the flash spinning method. Moreover, in each of these methods, secondary processing is necessary for preparing a fiber bundle, and this secondary processing is very difficult because the strength of the fiber is very low.

Accordingly, there has been proposed a polymer blend fiber dissolving process or arranged polymer fiber dissolving process in which a filament having an islands-in-sea structure is spun by using two kinds of resin components, an ultra-fine filament of the island component is left while extracting and removing the sea component and these ultra-fine filaments are gathered to form a fiber bundle. However, in most of known techniques of the polymer blend fiber dissolving process, the length of the island component in the longitudinal direction is short and hence, it is difficult to form continuous filaments. A trial to form continuous filaments is proposed in Japanese Patent Publication No. 21167/69, but in an ultra-fine filament bundle prepared according to this proposal, ultra-fine filaments are entangled in the net-like form and the arrangement of ultra-fine filaments is disturbed. In the latter-mentioned arranged polymer fiber dissolving process, since the island component is long and continuous in the longitudinal direction, a bundle of continuous ultra-fine filaments can be prepared and in the obtained fiber bundle, the constituent ultra-fine filaments are independently arranged in parallel to one another. However, since a spinneret having a special structure should be used, the apparatus becomes complicated and expensive. Moreover, in these processes, a bundle of ultra-fine filaments cannot be obtained unless the post treatment of extracting the sea component is carried out.

SUMMARY OF THE INVENTION

Under this background, we made research with a view to developing a process of preparing an ultra-fine filament bundle without special secondary processing or post treatment, and as the result, we succeeded in developing a spinning technique not expected from the conventional technical common sense, that is, a spinning technique according to which a fiber spun from one spinning hole is already a yarn composed of gathered ultra-fine filaments. Thus, we have now completed the present invention.

More specifically, in accordance with the present invention, there is provided a process for the preparation of synthetic fibers, which comprises melt-kneading a non-water-swelling or water-insoluble thermoplastic resin, water and an assistant for assisting dispersion of water into the thermoplastic resin and extruding the kneaded composition from an orifice under such conditions that flashing of water is substantially prevented, whereby a fiber bundle in which a great number of fine single filaments having a diameter smaller than 200 μm are gathered substantially in parallel to one another is formed from every orifice hole.

Furthermore, in accordance with the present invention, there is provided a synthetic fiber which is formed from a melt-kneaded composition comprising a non-water-swelling or water-insoluble olefin resin, a water-insoluble and non-water-swelling acid-modified olefin resin containing a carboxylic acid salt group in an amount of 0.1 to 5 millimole equivalents as the group $$-\underset{\underset{O}{\|}}{C}-O-$$

per gram of the polymer or a water-soluble thermoplastic resin, water and a surface active agent or organic solvent as an optional component, wherein the resin components in the melt-kneaded composition are present in the form of a fiber bundle in which a great number of single filaments having a substantially circular section and a diameter smaller than 200 μm are gathered substantially in parallel to one another, and in the fiber bundle, the single filaments are partially bonded to one another.

BRIEF DESCRIPTION OF THE DRAWINGS

FIGS. 1, 2, 3 and 4 are microscope photos showing the state of filaments of the synthetic fiber of the present invention, in which FIG. 1 is a photo (2 magnifications) showing the filament bundle, each of FIGS. 2 and 3 is a photo (5 magnifications) showing the state where the filament bundle is separated, and FIG. 4 is an enlarged photo (40 magnifications) showing a part of the separated filament bundle.

DETAILED DESCRIPTION OF THE PREFERRED EMBODIMENTS

Figure 1:
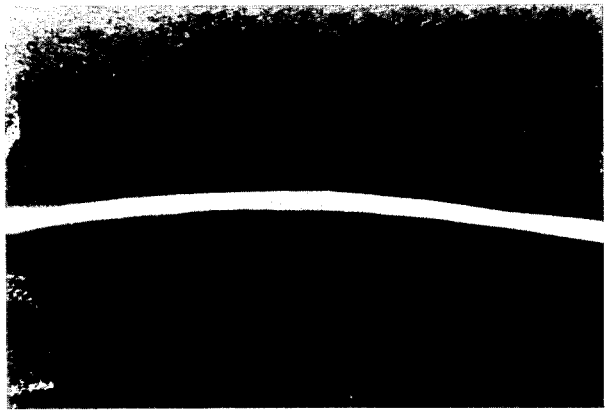

The present invention will now be described in detail.

(Thermoplastic Resin)

Either crystalline thermoplastic resins or amorphous thermoplastic resins can be used as the thermoplastic resin in the present invention, so far as they are water-insoluble and have a fiber-forming property. As the thermoplastic resin, there can be mentioned, for example, high pressure method low density polyethylene, medium or low pressure method low density polyethylene, high density polyethylene, super-high-molecular weight polyethylene, polypropylene, super-high-molecular weight polypropylene, poly-1-butene, poly-3-methyl-1-butene, poly-4-methyl-1-pentene, random and block copolymers of α-olefins such as ethylene, propylene, 1-butene, 3-methyl-1-butene, 1-pentene, 4-methyl-1-pentene, 1-hexene and 1-decene, α-olefin/conjugated or unconjugated diene copolymers such as ethylene/butadiene copolymers and ethylene/ethylidene-norbornene copolymers, copolymers of at least two α-olefins with a conjugated or unconjugated diene such as ethylene/propylene/butadiene terpolymers, ethylene/propylene/dicyclopentadiene terpolymers, ethylene/propylene/1,5-hexadiene terpolymers and ethylene/propylene/ethylidenenorbornene terpolymers, ethylene/vinyl compound copolymers such as ethylene/acrylic acid copolymers, ethylene/vinyl acetate copolymers, ethylene/vinyl alcohol copolymers and ethylene/vinyl chloride copolymers, styrene resins such as polystyrene, acrylonitrile/styrene copolymers, acrylonitrile/butadiene/styrene copolymers, methyl methacrylate/styrene copolymers and α-methylstyrene/styrene copolymers, vinyl polymers such as polyvinyl chloride, polyvinylidene chloride, vinyl chloride/vinyldiene chloride copolymers, polymethyl methacrylate and polymethyl acrylate, polyamides such as nylon 6, nylon 66, nylon 610, nylon 11 and nylon 12, thermoplastic polyesters such as polyethylene terephthalate and polybutylene terephthalate, polycarbonates, polyphenylene oxides, polysulfones, polyphenylene sulfides, polyether ether ketones, and mixtures of two or more of the foregoing resins.

In the present invention, various resins such as mentioned above can be used. Among these resins, olefin resins are especially advantageously used. The present invention is characterized in that polymers from which ultra-fine filaments can hardly be prepared according to the conventional techniques, such as low density polyethylene, super-high-molecular-weight polyethylene and ethylene/vinyl acetate copolymers, can be used as well as other resins.

(Assistant)

The assistant as another component used in the present invention exerts such a function that while the thermoplastic resin is kneaded with water, water is gradually dispersed in the thermoplastic resin to cause phase inversion and finally, an aqueous dispersion in which the thermoplastic resin is dispersed in water as the continuous phase is formed. It is believed that if such phenomenon can be caused to occur by melt-kneading, it becomes possible to prepare ultra-fine filament bundles from respective single orifices. Namely, if the thermoplastic resin is merely melt-kneaded with water without using any assistant, an ultra-fine filament bundle cannot be formed, and the object of the present invention cannot be attained.

Generally speaking, the assistant exerting the above-mentioned function has both of hydrophilic and oleophilic groups in the molecule. More specifically, compounds described below are used singly or in the form of a mixture of two or more of them.

(A) Water-swelling or water-soluble thermoplastic resin.

(B) Hardly water-soluble or water-insoluble thermoplastic resin modified with an unsaturated carboxylic acid.

(C) Surface active agent (used in combination with component (A) and/or component (B)).

(D) Organic solvent (used in combination with component (A) and/or component (B)).

(E) Other compound (used in combination with component (A) and/or component (B))

These assistants will now be described.

(A) Water-Swelling or Water-Soluble Thermoplastic Resin

A thermoplastic resin which is swollen with water or dissolved (indefinitely swollen) in water is used. For example, there can be mentioned polyvinyl alcohol, methyl cellulose, carboxymethyl cellulose, a sodium salt thereof, polyacrylic acid, sodium polyacrylate and polyacrylic amide.

Among these resins, polyvinyl alcohol, especially partially saponified polyvinyl alcohol having a saponification degree of 65 to 98%, particularly 80 to 97%, is preferred.

When this assistant is kneaded with the above-mentioned thermoplastic resin and water, the assistant is first kneaded in the thermoplastic resin homogeneously, and then, the assistant is swollen with water to finely cut the thermoplastic resin. Then, water permeates into the interior and swells the assistant present in the interior to promote cutting of the thermoplastic resin, and finally, there is formed an aqueous dispersion in which the thermoplastic resin is finely divided by water.

The assistant of this type is characterized in that the number of thermoplastic resins to which the assistant can be applied is smaller than the number of thermoplastic resins to which the assistant described below can be applied, and when the prepared ultra-fine filament bundle is allowed to stand still, ultra-fine filaments are tightly bonded to one another with the lapse of time and the formed filament bundle has hydrophilic characteristics.

(B) Hardly Water-Soluble or Water-Insoluble Thermoplastic Resin Modified with Unsaturated Carboxyic Acid This assistant is obtained by graft-copolymerizing a hardly water-soluble or water-insoluble resin with an unsaturated carboxylic acid, or by random-polymerizing or block-copolymerizing an unsaturated carboxyic acid in a hardly water-soluble or water-insoluble resin. A hardly water-soluble or water-insoluble resin having a good compatibility with the thermoplastic resin as the starting fiber-forming material and a low melt viscosity is preferred.

An index of the compatibility is a solubility parameter (Sp value), and it is preferred that the difference of the solubility parameter between the fiber-forming thermoplastic resin and the thermoplastic resin as the assistant (before neutralization or saponification) be less than 2 $(cal/cm^3)^{\frac{1}{2}}$, especially less than 1 $(cal/cm^3)^{\frac{1}{2}}$.

In the instant specification, the solubility parameter (Sp value) has the ordinary meaning. Namely, it is defined as the square root of the cohesion energy density. The solubility parameter is calculated from the value Vi of contribution of the atomic group to the molar volume and the cohesion energy En of the atomic group, as shown in D. W. Van Klevelen, "Properties of polymers" (Elsevier, 1972), according to the following equation:

$$Sp = \left(\frac{\Sigma Eni}{\Sigma Vi}\right)^{\frac{1}{2}} (cal/cm^3)^{\frac{1}{2}}$$

As the resin having a low melt viscosity, there can be mentioned a waxy resin having a low molecular weight.

This modified resin has a carboxyl group derived from the unsaturated carboxylic acid or a derivative group thereof. Accordingly, this modified resin is hydrophilic. However, since the base resin is hardly water-soluble or water-insoluble, the modified resin is not swollen with water.

The unsaturated carboxylic acid unit in the modified resin is an unsaturated carboxylic acid or its ester or an unsaturated carboxylic acid salt formed by neutralization or saponification. A modified resin in which an unsaturated carboxylic acid is contained in an amount of 0.1 to 5 millimole equivalents, especially 0.2 to 4 millimole equivalents, as $$-\underset{\underset{O}{\|}}{C}-O-$$

per gram of the polymer is preferred.

The modified resin is a copolymer of a monomer constituting the above-mentioned hardly water-soluble or water-insoluble resin with an unsaturated carboxylic acid. As the unsaturated carboxylic acid or the like, there can be mentioned acrylic acid, methacrylic acid, maleic acid, fumaric acid, tetrahydrophthalic acid, itaconic acid, citranoic acid, crotonic acid, isocrotonic acid, Nadic Acid ®(endo-cis-bicyclo(2,2,1)hepto-5-ene-2,3-dicarboxylic acid), maleic anhydride and citraconic anhydride. As the unsaturated carboxylic acid ester, there can be mentioned methyl, ethyl and propyl monoesters and diesters of the above-mentioned unsaturated acids. Furthermore, there can be mentioned alkali metal salts, alkaline earth metal salts and ammonium salts of the above mentioned unsaturated acids. Of course, as is apparent to those skilled in the art, a modified resin may be obtained by graft-polymerizing an ethylenically unsaturated carboxylic acid or its anhydride or ester to a thermoplastic resin, for example, an olefin resin, instead of copolymerizing a plurality of monomer components.

As pointed out hereinbefore, the preferred modified resin contains an unsaturated carboxylic acid salt in an amount of 0.1 to 5 millimole equivalents as $$-\underset{\underset{O}{\|}}{C}-O-$$

per gram of the polymer. This modified resin may be prepared by neutralizing or saponifying a thermoplastic resin modified with an unsaturated carboxylic acid or its anhydride or ester with a basic substance.

As the basic substance to be used for neutralization and saponification, there can be mentioned a metal or the like acting as a base in water, such as alkali metal, an alkaline earth metal, ammonia or an amine, a substance acting as a base in water, such as an oxide, hydroxide, weak acid salt or hydride of an alkali metal or an oxide, hydroxide, weak acid salt or hydride of an alkaline earth metal, and an alkoxide of a metal as mentioned above. Specific examples are as follows.

(1) Alkali metals such as sodium and potassium, and alkaline earth metals such as calcium, strontium and barium.

(2) Amines such as inorganic amines, for example, hydroxylamine and hydrazine, and methylamine, ethylamine, ethanolamine and cyclohexylamine.

(3) Oxides, hydroxides and hydrides of alkali metals and alkaline earth metals such as sodium oxide, sodium peroxide, potassium oxide, potassium peroxide, calcium oxide, strontium oxide, barium oxide, sodium hydroxide, potassium hydroxide, calcium hydroxide, strontium hydroxide, barium hydroxide, sodium hydride, potassium hydride and calcium hydride.

(4) Weak acid salts of alkali metals and alkaline earth metals such as sodium carbonate, potassium carbonate, sodium hydrogencarbonate, potassium hydrogencarbonate, calcium hydrogencarbonate, sodium acetate, potassium acetate and calcium acetate.

(5) Ammonia and amines such as ammonium hydroxide and quaternary ammonium compounds, for example, tetramethyl ammonium hydroxide and hydrazine hydrate.

As the carboxylic acid group or carboxylic acid ester group neutralized or saponified by the basic substance, alkali metal carboxylates such as sodium carboxylate and potassium carboxylate and ammonium carboxylate, especially potassium carboxylate, are preferred.

(C) Surface Active Agent

The surface active agent is not singly used as the assistant but it is used in combination with the assistant (A) and/or the assistant (B). Any of anionic surface active agents, cationic surface active agents, nonionic surface active agents and amphoteric surface active agents can be used as the surface active agent. In order to prepare ultra-fine filaments having a diameter smaller than 100 μm, especially smaller than 50 μm, it is preferred that an anionic surface active agent or a nonionic surface active agent be used in combination with the assistant (A) and/or the assistant (B).

As the anionic surface active agent, there can be used not only compounds that can directly act as the surface active agent but also organic compounds that can be finally converted to surface active agents by reaction with the above-mentioned basic substances (1) through (5). More specifically, when the thermoplastic resin is melt-kneaded with the assistant (A) and/or the assistant (B) and such an organic compound and a basic substance is then added to the kneaded mixture to convert the organic compound to an anionic surface active agent while continuing melt-kneading, the thermoplastic resin is mixed with the anionic surface active agent more intimately and ultra-fine filaments having a smaller diameter can be obtained.

Any organic compound that can be converted to an anionic surface active agent by reaction with a basic substance can be used. As preferred examples, there can be mentioned primary higher fatty acids, secondary higher fatty acids, primary higher alcohol sulfuric acid esters, secondary higher alcohol sulfuric acid esters, primary higher alkylsulfonic acids, secondary higher alkylsulfonic acids, higher alkyl disulfonic acids, sulfonated higher fatty acids, higher fatty acid sulfuric acid esters, higher fatty acid ester sulfonic acids, higher alcohol ether sulfuric acid esters, higher alcohol ether sulfonic acids, higher fatty acid amide alkylolated sulfuric acid esters, alkylbenzene sulfonic acids, alkylphenol sulfonic acids, alkylnaphthalene sulfonic acids and alkylbenzimidazole sulfonic acids. Among these compounds, higher fatty acids, especially saturated and unsaturated higher fatty acids having 10 to 20 carbon atoms, are preferred. For example, there can be mentioned saturated fatty acids such as capric acids undecanoic acid, lauric acid, myristic acid, palmitic acid, margaric acid, stearic acid and arachic acid, and unsaturated fatty acids such as linderic acid, zudic acid, petroselinic acid, oleic acid, linoleic acid, linolenic acid and arachidic acid, and mixtures thereof. Saturated fatty acids are especially preferred.

Typical examples of the surface active agent will now be described. As typical examples of the anionic surface active agent, there can be mentioned primary higher fatty acid salts, secondary higher fatty acid salts, primary higher alcohol sulfuric acid ester salts, secondary higher alcohol sulfuric acid ester salts, primary higher alkylsulfonic acid salts, secondary higher alkylsulfonic acid salts, higher alkyl disulfonic acid salts, sulfonated higher fatty acid salts, higher fatty acid sulfuric acid ester salts, higher fatty acid ester sulfonic acid salts, higher alcohol ether sulfuric acid ester salts, higher alcohol ether sulfonic acid salts, higher fatty acid amide alkylolated sulfuric acid ester salts, alkylbenzene sulfonic acid salts, alkylphenol sulfonic acid salts, alkylnaphthalene sulfonic acid salts and alkylbenzimidazole sulfonic acid salts. As typical examples of the nonionic surface active agent, there can be mentioned alkyl ethers, alkylallyl ethers, alkyl thioethers, alkyl esters, sorbitol monoalkyl esters, polyoxyethylene alkylamines, polyoxyethylene alkylamides, polyoxyethylenepolyoxypropylene, pentaerythritol esters, sucrose esters, fatty acid ethanolamides, methylolamides and oxymethylethanolamides.

Anionic and nonionic surface active agents other than those mentioned above, and cationic and amphoteric surface active agents may be used. Specific examples of these surface active agents are disclosed in Hiroshi Horiguchi, "Synthetic Surfactants" (published by Sankyo Shuppan, 1966).

When an anionic surface active agent converted from an organic compound by addition of a basic substance is used, the formed ultra-fine filament has an alkaline property, that is, a pH value larger than 9. When a nonionic surface active agent is used, the formed ultra-fine filament bundle has a substantially neutral characteristic. In order to form ultra-fine filaments having a further reduced diameter, it is preferred that 1 nonionic surface active agent having an HLB value of 13 to 19, preferably 14 to 19, be used. The HLB value is calculated according to the Griffin's equation, and HLB values of various surface active agents are shown in Ichiro Nisshi, et al., "Handbook of Surface Active Agents", pages 307 through 310 (published by Sangyo Tosho, 1960).

(D) Organic Solvent

The organic solvent is used when a thermoplastic resin which has a high molecular weight or a narrow molecular weight distribution and a high melt viscosity and is difficult to melt-knead is formed into an ultra-fine filament bundle. Accordingly, the organic solvent exhibits an excellent effect when it is applied to a resin having a melt flow rate (MFR) lower than 1 g/10 min as determined according to the method of ASTM D-1238. Of course, however, the organic solvent can be applied to a resin having a lower melt viscosity, that is, an MFR value larger than 1 g/10 min. The organic solvent is not used singly but in combination with the assistant (A) and/or the assistant (B) optionally with the assistant (C).

As the organic solvent, for example, there can be mentioned aromatic hydrocarbons such as benzene, toluene, xylene, styrene, α-methylstyrene and divinylbenzene, aliphatic hydrocarbons such as hexane and heptane, and halogenated hydrocarbons such as trichloroethylene.

(E) Other Assistant

Petroleum resin, rosin or asphalt may be used as the assistant (E) in combination with the assistant (A) and/or the assistant (B) optionally with the assistant (C) and/or the assistant (D). It is especially preferred that the assistant (E) be used in combination with the assistant (A).

(Preferred Modes of Assistants)

The assistants may be used in various modes. For example, there can be mentioned the single use of the assistant (A) or (B), the combined use of the assistants (A) and (B), the combined use of the assistant (A) and/or (B) and the assistant (C), the combined use of the assistant (A) and/or (B) and the assistant (D), the combined use of the assistant (A) and/or (B) and the assistants (C) and (D) and the combined use of the assistants (A) and (E). It is generally preferred that when filaments having a relatively large diameter (at least about 50 μm) are formed, the neutralized or saponified modified resin (B) be used, and that when filaments having a relatively small diameter (less than about 50 μm) are formed, the neutralized or saponified modified resin (B) and the surface active agent (C) be used. Especially, when neutral ultra-fine filaments are intended, a nonionic surface active agent is selected as the assistant (C) in the above-mentioned preferred combination, and when ultra-fine filaments of a resin having a high melt viscosity are intended, the neutralized or saponified modified resin (B), the surface active agent (C) and the organic solvent (D) are used in combination. When the filament bundle is strongly solidified, the water-soluble resin (A) is used.

The assistant most preferred for attaining the object of the present invention is a combination of a maleic acid-modified wax, especially a maleic acid-modified polyethylene wax, and a nonionic surface active agent having an HLB value of 13 to 19, especially 14 to 19.

The amount of the assistant is changed according to the kind of the thermoplastic resin to be formed into ultra-fine filaments and the kind of the assistant, but in general, there are used 75 to 98 parts by weight, especially 80 to 95 parts by weight, of the thermoplastic resin and 2 to 25 parts by weight, especially 5 to 20 parts by weight, of the assistant (the sum of the amounts of the two components is 100 parts by weight). In the case where the thermoplastic resin, the neutralized or saponified modified resin and the surface active agent are used according to the preferred embodiment of the present invention, the amounts of these components are 75 to 98 parts by weight, 1 to 20 parts by weight and 1 to 5 parts by weight, respectively, and especially, 80 to 95 parts by weight, 3 to 16 parts by weight and 2 to 4 parts by weight, respectively (the total amount is 100 parts by weight). When the water-swelling or water-soluble thermoplastic resin is used instead of the surface active agent in the above combination, the mixing ratio of the three components may be substantially the same as that described above.

(Addition of Water)

The amount of water to be added to the system comprising the thermoplastic resin and the assistant is 3 to 20 parts by weight, especially 5 to 15 parts by weight, per 100 parts by weight of the sum of the amounts of the thermoplastic resin and the assistant. If the amount of water is adjusted within this range, the thermoplastic resin can be formed into an intended ultra-fine filament bundle.

Various methods may be adopted for addition of water. For example, there can be mentioned a method in which water is added together with the thermoplastic resin and the assistant before melt kneading, and a method in which water is gradually added during melt kneading. Water to be added is not limited to pure water. For example, when a surface active agent is used as the assistant, water and the surface active agent may be simultaneously added in the form of an aqueous solution of the surface active agent.

(Preparation of Ultra-Fine Filament Bundle)

The ultra-fine filament bundle can be prepared by melt-kneading the above-mentioned thermoplastic resin with the assistant and water and spinning the melt-kneaded composition from an orifice such as a spinning nozzle. According to this process, one fiber bundle comprising ultra-fine filaments having a diameter smaller than 200 μm, which are gathered substantially in parallel to one another, is formed from one orifice hole.

In the present invention, it is important that the melt-kneaded composition should be extruded under such conditions that flashing of water is substantially prevented. Furthermore, it must be noted that according to the process of the present invention, one fiber bundle is formed from every orifice hole. Moreover, in order to form the melt-kneaded resin composition into single filaments gathered substantially in parallel to one another, it is ordinarily necessary that kneading should be carried out so that a shearing force does not act in a direction parallel to the direction of the screw groove in the extruder, that is, the shearing force acts two-dimensionally except this parallel direction. This point will now be described. Under such melt-kneading conditions that the shearing force acts three-dimensionally as in case of melt kneading in a biaxial extruder, there is formed a so-called o/w dispersion in which the dispersed phase of the molten resin particles is dispersed in water as the continuous phase. In the dispersion formed by melt kneading according to the present invention. the molten resin forms a phase of a great number of independent columns arranged in the direction of the screw groove and water forms a filling phase filling clearances among these columns. In this case, in the plane parallel to the direction of the screw groove, there is formed a so-called o/w dispersion in which the molten resin forms the dispersed phase and water forms the continuous phase, but in the direction of the screw groove, both the molten resin and water are substantially continuous. Water added to the system is gradually included into the molten resin by the shearing force generated by kneading and the action of the assistant, and a w/o type dispersion is first formed. However, as the two-dimensional shearing force is continuously applied, there is formed the above-mentioned dispersion comprising the dispersed phase of the resin and the continuous phase of water in the plane parallel to the direction of the screw groove, though the amount of water is relatively small (3 to 20 parts by weight per 100 parts by weight of the sum of the thermoplastic resin and the assistant).

As pointed out above, the resin just before the phase inversion is in the form of independent columns, that is, filaments separated from one another by water as the boundary phase, but in this state, the filaments of the resin are randomly oriented. In the present invention, the melt-kneaded composition in this state is passed through the orifice, whereby the filaments are oriented in a certain direction and gathered substantially in parallel to one another. This spinning process of the present invention is different from the conventional melt spinning process in the following point. Namely, irrespectively of the orifice configuration, when the melt-kneaded composition is passed through the orifice, one fiber bundle composed of a great number of ultra-fine filaments (having a diameter smaller than 200 μm) gathered substantially in parallel to the extrusion direction is formed from every orifice hole.

When the melt-kneaded composition is finally spun to the outside, flashing of water contained in the composition should be substantially prevented. Namely, violent extrusion such as causing flashing of water, as adopted in the conventional flash spinning process, should be avoided. For example, if the melt-kneaded composition is violently extruded as in the conventional flash spinning process or is extruded in a zone of a reduced pressure, the water film adhering to each single filament is evaporated and single filaments are fusionbonded to one another, and the intended fiber bundle cannot be formed. More specifically, in the process of the present invention, spinning is carried out under pressure or the pressure in the melt kneading machine is maintained at a level substantially equal to atmospheric pressure and spinning is carried out under atmospheric pressure.

The water content in the obtained fiber bundle is substantially the same as the amount of water present in the melt-kneaded composition. However, it sometimes happens that a certain amount of water is evaporated during spinning. Furthermore, in final filaments obtained by opening the fiber bundle, the water content can be substantially zero because of evaporation of water.

For the reasons described hereinbefore, it is preferred that the extruder used in the present invention be a monoaxial extruder in which a shearing force does not act in a direction parallel to the direction of the screw groove. A metering screw or a full-flighted screw is preferably used as the screw.

Not only an ordinary spinneret having a single orifice hole or a plurality of orifice holes but also a porous member such as a mesh screen can be used as the orifice member. In case of the mesh screen, it must be understood that each of mesh apertures act as an independent orifice. Furthermore, a T-die and a circular die can be used as the orifice member.

At least one screen is ordinarily interposed between the extruder and the orifice member. According to the present invention, it has been found that the diameter of single filaments in the fiber bundle can be adjusted by changing the mesh size (aperture size) of the screen. More specifically, if a 100-mesh (Tyler standard size; the same will apply hereinafter) screen is used, the diameter of the single filaments is adjusted to 25 to 50 μm, and if a 400-mesh screen is used, the diameter of the single filaments is adjusted to 1 to 30 μm.

(Properties and Uses of Synthetic Fibers)

The spun product obtained by the present invention is a fiber bundle in which a great number of ultra-fine filaments of a thermoplastic resin having a substantially circular section, an indefinite length and a diameter smaller than 200 μm, especially smaller than 100 μm, are gathered substantially in parallel to one another in the untwisted state and the ultra-fine filaments are partially bonded to one another. In the as-spun state, a molecular film of water is present on the surface of each single filament. When this fiber bundle is opened, respective single filaments are independently formed, or an assembly consisting of entangled single filaments is obtained.

Opening of the fiber bundle can be accomplished by mechanical means such as a so-called carding machine or by a method using a fluid, such as air blowing or water jetting. Furthermore, when the fiber bundle obtained by spinning is cut into a predetermined size and is then passed through an opener or through a grinder such as a pulper, a wadding of the single filaments or a disintegrated slurry of the single filaments can be obtained.

According to a preferred embodiment of the present invention, the fiber bundle is opened and disintegrated by blowing the fiber bundle by air. If the linear speed of air is changed and adjusted, the fiber length can be changed within a broad range of from the length of continuous filaments to the length of cut staples. For this purpose, there is preferably used a two-fluid nozzle having a fiber bundle-extruding orifice at the center and an annular blow-out opening formed around the orifice.

Figure 2:
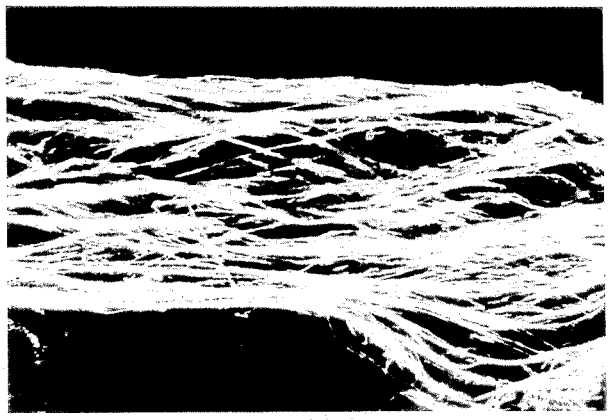
Figure 3:
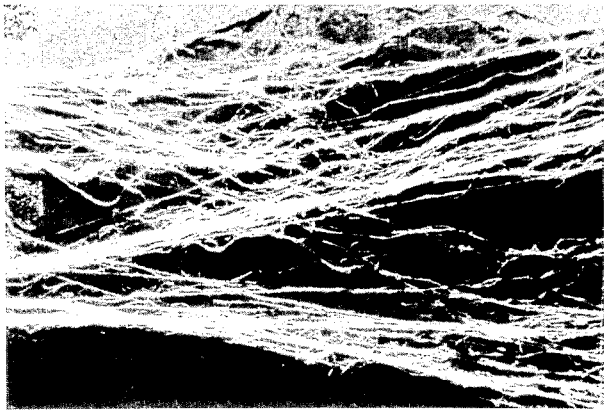
Figure 4:
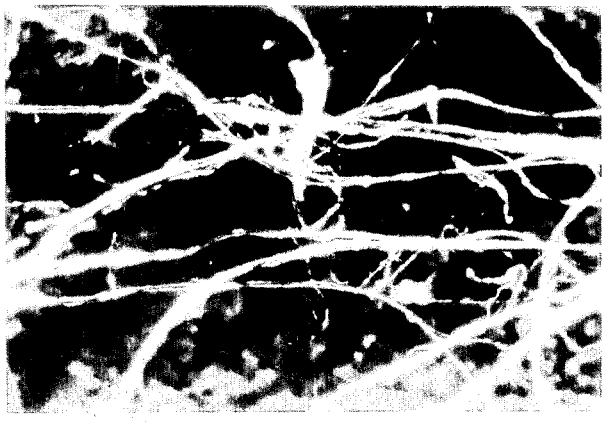

An example of the ultra-fine filament bundle of the present invention is illustrated in photos of FIGS. 1 through 4 of the accompanying drawings. FIG. 1 is a photo (2 magnifications) of the fiber bundle of the present invention, and from this photo, it is seen that the fiber bundle is not twisted at all. FIGS. 2 (5 magnifications) and 3 (5 magnifications) are photos showing the opened state of the fiber bundle, and from FIGS. 2 and 3, it is seen that the fiber bundle consists of a great number of ultra-fine filaments gathered substantially in parallel to one another. FIG. 4 is an enlarged photo (40 magnifications) showing a part of the opened fiber bundle, and from FIG. 4, it is seen that the ultra-fine filaments are partially bonded to one another.

Figure 5:
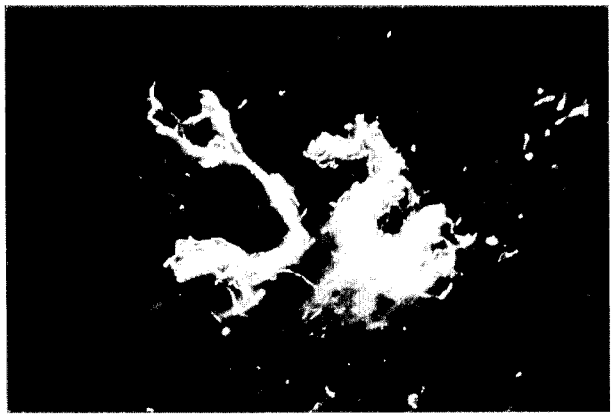
FIG. 5 is a photo (5 magnifications) showing the state produced when the filament bundle is opened and single filaments are drawn and cut by air-blowing.

FIG. 5 is a microscope photo (5 magnifications) showing wadding like short fibers obtained by drawing and cutting single filaments simultaneously with opening by using the above-mentioned two-fluid nozzle at an increased air jet speed.

Figure 6:
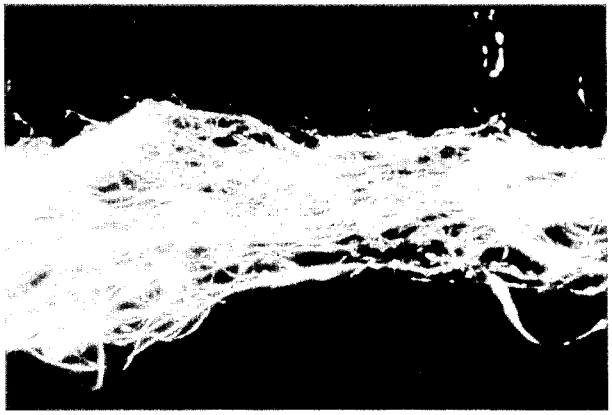
FIG. 6 is a photo (5 magnifications) showing the state produced when only the opening of the filament bundle is effected by air-blowing.

FIG. 6 is a microscope photo (5 magnifications) of continuous filaments obtained by only opening the fiber bundle by using the above-mentioned two-fluid nozzle at a reduced air jet speed.

Figure 7:
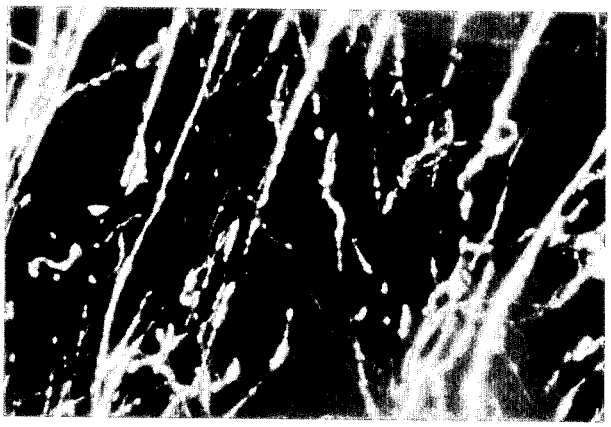
FIG. 7 is an enlarged photo (40 magnifications) showing the state where the diameter of single filaments is attenuated.

FIG. 7 is an enlarged photo (40 magnifications) showing a fiber bundle of single filaments having a much reduced diameter, which is obtained by arranging a screen having a reduced mesh size at the outlet of the extruder.

The synthetic fiber according to the present invention, especially one composed of polyethylene or an ethylene type copolymer such as an ethylene/vinyl acetate copolymer, has such a property that it melts at a relatively low temperature even though it is in the form of a fiber. By utilizing this characteristic, the synthetic fiber of the present invention can be used as a fusion-bonding yarn for bonding other fibers by incorporating the synthetic fiber of the present invention into a non-woven fabric or artificial paper composed of other fibers. As examples of this use, there can be mentioned paper diapers, paper towels, paper napkins, sanitary articles, padding cloths, bandages and wiping cloths.

The present invention will now be described in detail with reference to the following examples that by no means limit the scope of the invention.

EXAMPLE 1

A mixture of 93 parts by weight of low density polyethylene (Mirason ®FL-60 supplied by Mitsui Petrochemical Industry, MFR=70 g/10 min, density=0.915 g/cm$^3$, Sp value=7.80 (cal/cm$^3$)$^{1/2}$) and 5 parts by weight of maleic anhydride-grafted polyethylene (maleic anhydride content=3.3% by weight, $$-\underset{\underset{O}{\|}}{C}-O-$$

group content=0.67 millimole equivalent per gram, $\overline{Mw}$=2700, density=0.94 g/cm$^3$, Sp value=8.06 (cal/cm$^3$)$^{1/2}$) was continuously supplied at a rate of 98 parts by weight per hour from a hopper of a vented monoaxial extruder having a water-cooling mechanism in the top end portion and liquid injection openings in a first compression zone and a first metering zone (supplied by Thermoplastics Co., diameter×30 mm, L/D =36), and the mixture was plasticized at 140° C. Then, a 16.7% aqueous solution of an anionic surface active agent (Emulgen ®430 supplied by Kao Soap, polyoxyethylene oleyl ether having an HLB value of 16.2) was continuously supplied at a rate of 12 parts by weight per hour under a pressure of 120 kg/cm$^2$G by a plunger pump from the liquid injection opening formed in the first metering zone, and at an extrusion temperature of 95° C., the mixture was extruded from a nozzle having a diameter of 3 mm through a 100-mesh screen.

The product was a white fiber bundle consisting of single filaments gathered substantially in parallel to one another. When the water content was measured, it was found that the water content was 9% by weight. Then, the fiber bundle was opened and the single filaments were observed by a microscope. It was found that the single filaments were partially bonded to one another. The diameter of the single filaments was ordinarily within the range of from 25 to 50 μm.

EXAMPLE 1-2

The procedures of Example 1 were repeated in the same manner except that a two-fluid nozzle having a fiber bundle extrusion orifice at the center and an annular air jet opening around the orifice was used instead of the nozzle used in Example 1. It was confirmed that a fiber bundle was opened conveniently according to this process.

When by increasing the pressure of compressed air, the jetting speed of air was increaed so that the linear speed was 40 m/sec, the fiber bundle was drawn and cut into a short length simultaneously with opening, whereby a wadding-like fiber as shown in the photo of FIG. 5 was obtained. When the pressure of compressed air was reduced and the jetting speed of air was reduced so that the linear speed was 10 m/sec, the fiber bundle was opened but the single filaments were kept continuous. The photo of this state is shown in FIG. 6.

EXAMPLE 1-3

The procedures of Example 1 were repeated in the same manner except that a 400-mesh screen was used instead of the 100-mesh screen. The diameter of the single flaments was reduced and was within the range of from 1 to 30 μm. The photo of the product is shown in FIG. 7.

EXAMPLES 2 through 9

The procedures of Example 1 were repeated in the same manner except that the composition was changed as shown in Table 1. The obtained results are shown in Table 1.

TABLE 1

| Example No. | Resin | | Modified Thermoplastic Resin | | Surface Active Agent | |
|---|---|---|---|---|---|---|
| | Kind | Amount (parts by weight) | Kind | Amount (parts by weight) | Kind | Amount (parts by weight) |
| 1 | low density polyethylene*1 | 93 | maleic anhydride-grafted polyethylene*6 | 5 | polyoxyethylene oleyl ether (HLB = 16.2) | 2 |
| 2 | low density polyethylene*1 | 98 | maleic anhydride-grafted polyethylene*6 | 1 | polyoxyethylene oleyl ether (HLB = 16.2) | 1 |
| 3 | low density polyethylene*1 | 75 | maleic anhydride-grafted polyethylene*6 | 20 | polyoxyethylene oleyl ether (HLB = 16.2) | 5 |
| 4 | low density polyethylene*1 | 93 | maleic anhydride-grafted polyethylene*7 | 5 | polyoxyethylene oleyl ether (HLB = 16.2) | 1 |
| 5 | ethylene/vinyl acetate copolymer resin*2 | 93 | maleic anhydride-grafted polyethylene*7 | 5 | polyoxyethylene sorbitol monopalmitate (HLB = 15.6) | 2 |
| 6 | ethylene/vinyl acetate copolymer resin*2 | 93 | ethylene/acrylic acid copolymer resin*8 | 5 | polyoxyethylene lauryl ether (HLB = 15.3) | 2 |
| 7 | ethylene/1-butene copolymer resin*3 | 93 | ethylene/acrylic acid copolymer resin*8 | 5 | polyoxyethylene nonylphenyl ether (HLB = 17.5) | 2 |
| 8 | polystyrene*4 | 93 | ethylene/acrylic acid copolymer resin*8 | 5 | polyoxyethylene nonylphenyl ether (HLB = 17.5) | 2 |
| 9 | vinyl chloride resin*5 | 93 | maleinated polybutadiene resin*9 | 5 | polyoxyethylene glycol distearate (HLB = 18.3) | 2 |

| Example No. | Amount of Water (parts by weight) | Extrusion Temperature (°C.) | Product: Water Content (% by weight) | Product: Filament Diameter (μ) |
|---|---|---|---|---|
| 1 | 10 | 95 | 9 | 25-50 |
| 2 | 10 | 95 | 9 | 60-120 |
| 3 | 20 | 95 | 17 | 15-30 |
| 4 | 4 | 95 | 4 | 35-70 |
| 5 | 10 | 80 | 9 | 20-40 |
| 6 | 10 | 80 | 9 | 25-50 |
| 7 | 10 | 95 | 9 | 30-60 |
| 8 | 10 | 95 | 9 | 90-180 |
| 9 | 10 | 95 | 9 | 70-140 |

Note

*1MFR = 70 g/10 min, density = 0.915 g/cm$^3$, Sp value = 7.80 (cal/cm$^3$)$^{1/2}$

*2vinyl acetate content = 19% by weight, MFR = 150 g/10 min, density = 0.89 g/cm$^3$, Sp value = 8.06 (cal/cm$^3$)$^{1/2}$

*3ethylene content = 93 mole %, MFR = 70 g/10 min, density = 0.94 g/cm$^3$, Sp value = 8.06 (cal/cm$^3$)$^{1/2}$

*4Diarex ® High-Flow 55 supplied by Mitsubishi-Monsanto, density = 1.05 g/cm$^3$, Sp value = 8.98 (cal/cm$^3$)$^{1/2}$

*5Geon$^R$ 101EP supplied by Nippon Zeon, density = 1.40 g/cm$^3$, Sp value = 9.64 (cal/cm$^3$)$^{1/2}$

*6maleic anhydride content = 3.3% by weight, $\overline{Mw}$ = 2700, density = 0.94 g/cm$^3$, Sp value = 8.06 (cal/cm$^3$)$^{1/2}$, $-\underset{\underset{O}{|}}{C}-O-$ group content = 0.67 millimole equivalent per gram

*7maleic anhydride content = 8.2% by weight, $\overline{Mw}$ = 3100, density = 0.95 g/cm$^3$, Sp value = 8.42 (cal/cm$^3$)$^{1/2}$, $-\underset{\underset{O}{\|}}{C}-O-$ group content = 1.67 millimole equivalents per gram

*8A—C Polyethylene ® 5120 supplied by Allied Chemical, acrylic acid content = 15% by weight, viscosity = 650 cps (140° C.), density = 0.93 g/cm$^3$, Sp value = 8.58 (cal/cm$^3$)$^{1/2}$, $-\underset{\underset{O}{\|}}{C}-O-$ group content = 2.14 millimole equivalents per gram

*9NISSO ®-PBBN-1015 supplied by Nippon Soda, maleic anhydride content = 13% by weight, viscosity = 800 cps (45° C.), density = 0.86 g/cm$^3$, Sp value = 9.53 (cal/cm$^3$)$^{1/2}$, $-\underset{\underset{O}{\|}}{C}-O-$ group content = 2.65 millimole equivalents per gram

EXAMPLE 10

A mixture (92/5/3 weight ratio) of low density polyethylene (Micrason ®FL-60 supplied by Mitsui Petrochemical Industry, MFR=70 g/10 min, density=0.915 g/cm$^3$, Sp value=7.80 (cal/cm$^3$)$^{½}$), maleic anhydride-grafted polyethylene (maleic anhydride content =3.3% by weight,

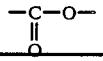

group content=0.67 millimole equivalent per gram, $\overline{Mw}$=2700, density =0.94 g/cm$^3$, Sp value=8.06 (cal/cm$^3$)$^{½}$) and stearic acid was continuously supplied at a rate of 100 parts by weight per hour from the hopper of the extruder used in Example 1, and the mixture was plasticized at 140° C. Then, a 9.8% aqueous solution of potassium hydroxide was continuously supplied at a rate of 8 parts by weight per hour under a pressure of 120 kg/cm$^2$G by a plunger pump from the liquid injection opening arranged in the first metering zone of the exturder. The composition was extruded at an extrusion temperature of 95° C. in the same manner as described in Example 1.

The product was a white fiber bundle consisting of single filaments gathered substantially in parallel to one another. When the fiber bundle was expanded and the diameter of the single filaments was examined, it was found that the diameter of the single filaments was ordinarily within the range of from 25 to 50 μm. When 5 parts by weight of the fiber bundle was added into 100 parts by weight of water, it was found that the pH value of the water layer was 10.5.

EXAMPLES 11 through 16

The procedures of Example 10 were repeated in the same manner except that the composition was changed as shown in FIG. 2. The obtained results are shown in Table 2.

TABLE 2

| Example No. | Resin: Kind | Resin: Amount (parts by weight) | Modified Thermoplastic Resin: Kind | Modified Thermoplastic Resin: Amount (parts by weight) | Surface Active Agent: Kind | Surface Active Agent: Amount (parts by weight) |
|---|---|---|---|---|---|---|
| 10 | low density polyethylene*1 | 92 | maleic anhydride-grafted polyethylene*4 | 5 | stearic acid | 3 |
| 11 | " | 98 | maleic anhydride-grafted polyethylene*4 | 1 | " | 1 |
| 12 | " | 75 | maleic anhydride-grafted polyethylene*4 | 20 | " | 5 |
| 13 | " | 92 | oxidized modified polyethylene wax*5 | 5 | dodecyl benzene-sulfonate | 3 |
| 14 | ethylene/vinyl acetate copolymer resin*2 | 92 | oxidized modified polyethylene wax*5 | 5 | dodecyl benzene-sulfonate | 3 |
| 15 | ethylene/vinyl acetate copolymer resin*2 | 92 | ethylene/acrylic acid copolymer resin*6 | 5 | lauric acid | 3 |
| 16 | ethylene/1-butene copolymer resin*3 | 92 | ethylene/acrylic acid copolymer resin*6 | 5 | oleic acid | 3 |

| Example No. | Base: Kind | Base: Amount (parts by weight) | Amount of Water (parts by weight) | Extrusion Temperature (°C.) | Product: Water Content (% by weight) | Product: Filament Diameter (μ) |
|---|---|---|---|---|---|---|
| 10 | KOH | 0.78 | 8 | 95 | 7 | 25-50 |
| 11 | " | 0.23 | 4 | 95 | 3 | 65-130 |
| 12 | " | 1.74 | 20 | 95 | 16 | 20-40 |
| 13 | NaOH | 5.20 | 10 | 95 | 9 | 40-80 |
| 14 | " | 5.20 | 10 | 90 | 9 | 20-40 |
| 15 | ammonia | 0.32 | 10 | 90 | 9 | 15-30 |
| 16 | ethanolamine | 0.87 | 10 | 95 | 9 | 20-40 |

Note
*1MFR = 70 g/10 min, density = 0.915 g/cm$^3$, Sp value = 7.80 (cal/cm$^3$)$^{½}$
*2vinyl acetate content = 28% by weight, MFR = 14 g/10 min, density = 0.95 g/cm$^3$, Sp value = 8.19 (cal/cm$^3$)$^{½}$
*3ethylene content = 93 mole %, MFR = 15 g/10 min, density = 0.89 g/cm$^3$, Sp value = 8.06 (cal/cm$^3$)$^{½}$
*4maleic anhydride content = 3.3% by weight, $\overline{Mw}$ = 2700, density = 0.94 g/cm$^3$, Sp value = 8.06 (cal/cm$^3$)$^{½}$
*5acid value = 20 KOH mg/g, $\overline{Mw}$ = 3200, density = 0.98 g/cm$^3$, Sp value = 7.92 (cal/cm$^3$)$^{½}$
*6A—C Polyethylene ® 540 supplied by Allied Chemical, acrylic acid content = 5% by weight, viscosity = 500 cps (140° C.), density = 0.93 g/cm$^3$, Sp value = 8.07 (cal/cm$^3$)$^{½}$

EXAMPLE 17

The same ethylene/1-butene copolymer resin as used in Example 16 was continuously supplied at a rate of 97 parts by weight per hour from the hopper of the extruder used in Example 1 and was plasticized at 150° C. An aqueous dispersion of an ethylene/acrylic acid copolymer resin shown in the Referential Example given hereinafter was heated at 80° C. and continuously supplied at a rate of 10 parts by weight per hour under a pressure of 140 kg/cm$^2$G by a plunger pump from the liquid injection opening formed in the first metering zone of the extruder. The mixture was extruded at an extrusion temperature of 95° C. in the same manner as described in Example 1.

The product was a white fiber bundle having a water content of 6% by weight. When the fiber bundle was expanded and observed, it was found that the fiber bundle looked like an opened yarn locally bonded and the diameter of single filaments was ordinarily within the range of from 70 to 140 μm.

REFERENTIAL EXAMPLE

An autoclave equipped with a stirrer was charged with 30 parts by weight of an ethylene/acrylic acid copolymer (AC-Polyethylene ®5120 supplied by Allied Chemical, acrylic acid content=15% by weight,

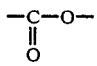

group content=2.14 millimole equivalents per gram, viscosity=650 cps (140° C.), density=0.93 g/cm$^3$, Sp value=8.58 (cal/cm$^3$)$^{\frac{1}{2}}$), 66 parts by eight of water and 3.60 parts by weight of potassium hydroxide (1.0 chemical equivalent to the

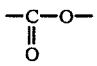

group), and the mixture was heated with agitating at 140° C. for 1 hour.

Then, the autoclave was cooled and the content was taken out, and a white jelly-like emulsion was obtained. The particle size of the emulsion was smaller than 0.5 μm, and the amount of the neutralized

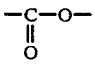

group was 2.1 millimole equivalents per gram of the polymer.

EXAMPLE 18

A mixture (92/5/3 weight ratio) of an ethylene/propylene copolymer resin (ethylene content=80 mole %, MFR=1.1 g/10 min, density=0.88 g/cm$^3$, Sp value=7.87 (cal/cm$^3$)$^{\frac{1}{2}}$), the same maleic anhydride-grafted polyethylene as used in Example 1 and stearic acid was continuously supplied at a rate of 75 parts by weight per hour from the hopper of the extruder used in Example 1, and the mixture was plasticized at 120° C. Tetrachloroethylene was continuously supplied at a rate of 25 parts by weight per hour from the liquid injection opening formed in the first compression zone of the extruder and a 4% aqueous solution of potassium hydroxide was continuously supplied at a rate of 15 parts by weight per hour from the liquid injection opening formed in the first metering zone of the extruder by means of a plunger pump. The composition was extruded at an extrusion temperature of 80° C. in the same manner as described in Example 1.

The product was a white fiber bundle, and the diameter of single filaments was ordinarily within the range of 55 to 110 μm.

EXAMPLE 19

An ethylene/vinyl acetate copolymer resin (vinyl acetate content=19% by weight, MFR=150 g/10 min, density=0.97 g/cm$^3$, Sp value=8.06 (cal/cm$^3$)$^{\frac{1}{2}}$) was continuously supplied at a rate of 98 parts by weight per hour from the hopper of the extruder used in Example 1 and was plasticized at 120° C. Then, a 10% aqueous solution of polyvinyl alcohol (Gosenol®KH-17 supplied by Nippon Gosei Kagaku Kogyo, saponification degree=80%) was continuously supplied at a rate of 20 parts by weight per hour under a pressure of 80 kg/cm$^2$G) by a plunger pump from the liquid injection opening formed in the first metering zone of the extruder, and the composition was extruded at an extrusion temperature of 90° C. in the same manner as described in Example 1.

The product was a white fiber bundle having a water content of 13% by weight. When the fiber bundle was expanded and observed, it was found that single filaments were arranged substantially in parallel to one another and they were partially bonded to one another, and the diameter of the single filaments was ordinarily within the range of from 35 to 70 μm.

When the fiber bundle was allowed to stand still at room temperature for one day, polyvinyl alcohol was formed into a film and opening of the bundle was impossible.

EXAMPLE 20

The procedures of Example 19 were repeated in the same manner except that a mixture comprising 90 parts by weight of the same low density polyethylene as used in Example 1 and 10 parts by weight of a hydrogenated petroleum resin (Alkon®P-1000supplied Arakawa Kagaku Kogyo, softening point=100° C., molecular weight=700) was continuously supplied at a rate of 98 parts by weight per hour insead of the ethylene/vinyl acetate copolymer used in Example 19 and the extrusion temperature was changed to 95° C.

The diameter of single filaments of the product was ordinarily within the range of from 30 to 60 μm.

EXAMPLE 21

The procedures of Example 20 were repeated in the same manner except that the same maleic anhydride-grafted polyethylene as used in Example 1 was used instead of the hydrogenated petroleum resin used in Example 20.

The diameter of single filaments of the product was ordinarily within the range of from 40 to 80 μm.

We claim:

1. A process for the preparation of a synthetic fiber bundle, which comprises (1) melt-kneading (a) a non-water-swelling or a water-insoluble thermoplastic resin, (b) water and (c) an assistant for assisting dispersion of water into the thermoplastic resin in an extruder having a screw groove under such conditions that a shearing force does not act in a direction parallel to the direction of said screw groove, but acts two-dimensionally other than in the parallel direction, (2) effecting a phase inversion of the kneaded composition to form a dispersion consisting of a phase of a great number of independent columns of molten resin arranged in the direction of the screw groove and a filling phase of water filling clearance among these columns, and (3) extruding the kneaded composition from an orifice under such conditions that flashing of water substantially prevented, whereby a fiber bundle in which a great number of fine single filaments having a diameter smaller than 200 μm are gathered substantially in parallel to one another is formed from every orifice hole.

2. A process for the preparation of a synthetic fiber bundle, which comprises (1) melt-kneading (a) a non-water-swelling or water-insoluble thermoplastic resin, (b) water and (c) an assistant for assisting dispersion of water into the thermoplastic resin, wherein the thermoplastic resin is present in an amount of 75 to 98 parts by weight, the assitant is present in an amount of 2 to 25 parts by weight, and water is present in an amount of 3 to 20 parts by weight per 100 parts by weight of the sum of the thermoplastic resin and assistant, in an extruder having a screw groove under such conditions that a shearing force does not act in a direction parallel to the direction of said screw groove, but acts two-dimensionally other than in the parallel direction, (2) effecting a phase inversion of the kneaded composition to form a dispersion consisting of a phase of a great number of independent columns of molten resin arranged in the direction of the screw groove and a filling phase of water filling clearance among these columns, and (3) extruding the kneaded composition from an orfice under such conditions that flashing of water is substantially prevented, thereby forming from every orifice hole a fiber bundle in which a great number of fine single filaments having a diameter smaller than 200 μm are gathered substantially in parallel to one another.

3. A process according to claim 2 wherein the thermoplastic resin is an olefin resin.

4. A process according to claim 2 wherein the thermoplastic resin is polyethylene or a copolymer of ethylene with an other ethylenically unsaturated monomer.

5. A process according to claim 2 wherein the assistant is a hardly water-soluble or a water-insoluble thermoplastic resin modified with an ethylenically unsaturated carboxylic acid.

6. A process according to claim 5, wherein the carboxylic acid is present in the neutralized or saponified state.

7. A process according to claim 5, wherein the neutralized carboxylic acid salt is present in an amount of 0.1 to 5 millimole equivalents as the

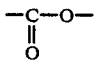

group per gram of the resin polymer.

8. A process according to claim 5, wherein the difference of the solubility parameter (Sp value) between the thermoplastic resin and the carboxylic acid-modified thermoplastic resin is less than 2 $(cal/cm^3)^{\frac{1}{2}}$.

9. A process according to claim 2, wherein the assistant is a water-swelling or a water-soluble thermoplastic resin.

10. A process according to claim 9, wherein the water-soluble thermoplastic resin is partially saponified polyvinyl alcohol having a saponification degree of 65 to 98%.

11. A process according to claim 2, wherein the assistant is a combination of (i) a hardly water-soluble or water-insoluble thermoplastic resin modified with an ethylenically unsaturated carboxylic acid and (ii) a surface active agent.

12. A process according to claim 11, wherein the surface active agent is a nonionic surface active agent having an HLB value of 13 to 19.

13. A process according to claim 2, wherein the thermoplastic resin, water and the assistant are kneaded by a monoaxial extruder provided with a screw having a weak shearing force.

14. A process according to claim 2, wherein the kneaded coposition is first passed through a screen having apertures of 50 to 1000 mesh, arranged in the extruder, and is then extruded from the orifice.

15. A process for the preparation of a synthetic fiber bundle which comprises (1) melt-kneading (a) a non-water-swelling or a water-insoluble thermoplastic resin, (b) water and (c) an assistant for assisting dispersion of water into the thermoplastic resin, in an extruder having a screw groove under such conditions that a shearing force does not act in a direction parallel to the direction of said screw groove, but acts two-dimensionally other than in the parallel direction, (2) effecting a phase inversion of the kneaded composition to form a dispersion consisting of a phase of a great number of indepnedent columns of molten resin arranged in the direction of the screw groove and a filling phase of water filling clearance among these columns, and (3) extruding the kneaded composition from an orifice under such conditions that flashing of water is substantially prevented, whereby a fiber bundle in which a great number of fine single filaments having a diameter smaller than 200 μm are gathered substantially in parallel to one another is formed from every orifice hole, a (4) blowing the fiber bundle by air to open the fiber bundle.

16. A process for the preparation of a synthetic fiber bundle, which comprises (1) melt-kneading (i) 75 to 98 parts by weight of a non-water-swelling or a water-insoluble thermoplastic resin, (ii) 1 to 20 parts by weight of a hardly water-soluble or a water-insoluble polymer resin containing a carboxylic acid salt group formed by neutralization or saponification in an amount of 0.1 to 5 millimole equivalents as the

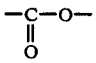

group per gram of the polymer, (iii) 1 to 5 parts by weight of a surface active agent and (iv) 3 to 20 parts by weight, per 100 parts by weight of the sum of the components (i), (ii) and (iii), of water, in an extruder having a screw groove under such conditions that a shearing force does not act in a direction parallel to the direction of said screw groove, but acts two-dimensionally other than in the parallel direction, (2) effecting a phase inversion of the kneaded composition to form a dispersion consisting of a phase of a great number of independent columns of molten resin arranged in the direction of the screw groove and a filling phase of water filling clearance among these columns, and (3) extruding the kneaded composition from an orifice under such conditions that flashing of water is substantially prevented, whereby a fiber bundle in which a great number of fine single filaments having a diameter smaller than 200 μm are gathered substantially in parallel to one another is formed from every orifice hole.

17. A process according to claim 16, wherein the theromoplastic resin (i) is polyethylene, the resin (ii) is a neutraliziation product of maleic anhydride-grafted polyethylene or polyethylene wax, and the surface active agent (iii) is a nonionic surface active agent having an HLB value of 13 to 19.

* * * * *

UNITED STATES PATENT AND TRADEMARK OFFICE

CERTIFICATE OF CORRECTION

PATENT NO. : 4,808,367

DATED : February 28, 1989

INVENTOR(S) : SHIRO HOMMA ET AL.

It is certified that error appears in the above-identified patent and that said Letters Patent is hereby corrected as shown below:

On the cover page of the patent, under Assignee, "ltd." should read --Ltd.--.

Claim 1, line 16 of the claim, after "water", --is-- should be inserted.

Claim 4, line 3 of the claim, "an other" should read --another--.

Claim 15, line 11 of the claim, "indepnedent" should read --independent--;

line 20, "a" should read --and--.

Claim 17, line 3 of the claim, "neutraliziation" should read --neutralization--.

Signed and Sealed this

Twenty-ninth Day of August, 1989

*Attest:*

*Attesting Officer*

DONALD J. QUIGG

*Commissioner of Patents and Trademarks*